US006137049A

United States Patent [19]

Hecock

[11] Patent Number: 6,137,049

[45] Date of Patent: Oct. 24, 2000

[54] ELECTRICAL GROUND CONNECTOR ASSEMBLY

[75] Inventor: John David Hecock, Wauseon, Ohio

[73] Assignee: E & J DeMark, Inc., Wauseon, Ohio

[21] Appl. No.: 09/127,853

[22] Filed: Aug. 3, 1998

[51] Int. Cl.[7] ..... H01R 4/00; H01R 4/58; H01R 4/66

[52] U.S. Cl. ..... 174/7; 174/6; 174/40 CC; 174/161 F; 174/166 R

[58] Field of Search ..... 174/7, 556, 6, 174/40 CC, 44, 182, 158 R, 158 F, 139, 161 F, 166 R

[56] References Cited

U.S. PATENT DOCUMENTS

| | | | |
|---|---|---|---|
| 1,661,712 | 3/1928 | Van Wagner | 174/7 |
| 2,712,567 | 7/1955 | Caltrider | 174/161 |
| 4,156,793 | 5/1979 | Carlson | 174/7 |
| 4,887,970 | 12/1989 | den Hartog | 439/92 |

*Primary Examiner*—Kristine Kincaid
*Assistant Examiner*—Mark Olds
*Attorney, Agent, or Firm*—McMillan, Sobanski & Todd, LLC

[57] ABSTRACT

An electrical ground connector assembly for providing a fast, secure, moisture-resistant ground connection without using special tools. The electrical ground connector assembly includes a ground rod and a cap having an tapered rod chamber for receiving the ground rod. The cap also includes a slot for receiving a ground wire. The angle of the slot may vary, depending on the diameter of the ground wire. The cap may be cylindrical or rectangular in shape. In installation, the ground wire is inserted into the slot of the cap. The upper end of the ground rod is forced into the rod cavity of the cap by any suitable manner, such as hammering the cap down over the ground rod. As the upper end of the ground rod reaches the end of the rod cavity, a compression contact is made between the wire and said ground rod. Alternatively, the ground rod can first be driven into the ground, and then the ground wire and the cap can be assembled on the ground rod.

15 Claims, 2 Drawing Sheets

ELECTRICAL GROUND CONNECTOR ASSEMBLY

BACKGROUND OF THE INVENTION

The invention relates generally to the field of electrical conductors, and in particular, to the field of devices with which an electrical grounding rod is driven into the ground.

Various conventional devices have been developed for sinking an electrical ground wire into the earth to establish contact with the electrically conductive earth. Typically, the ground rod should be installed near the ground wire and the base of the pole. Usually, the rod is driven its fall length into the ground. After being driven in place, the ground rod should have a resistance of less than 25 ohms. Then, the ground wire is wrapped around the mounting hardware bolt and the mounting hardware is tightened firmly to assure a continuing bond.

However, none of the prior art devices succeed in achieving a secure connection between the ground wire and ground rod with any degree of simplicity of structure or procedure. In addition, the prior art devices frequently require the use of complicated tools and a significant amount of time in assembly.

SUMMARY OF THE INVENTION

It is an object of the invention to provide an electrical ground connector assembly that insures a fast, secure connection between the ground wire and the ground rod without the need of special tools.

It is another object of the invention to provide an electrical ground connector assembly capable of accommodating ground wires and ground rods of different sizes.

To achieve these and other objects, the electrical ground connector assembly a ground rod having a lower end and an upper end, and a cap having a top and a bottom. The bottom of the cap includes an opening forming a tapered rod chamber capable of receiving the upper end of the ground rod. The cap includes a slot for receiving a wire. The slot has a length sufficient to traverse from an outer surface of the cap through the tapered rod chamber such that a compression contact is made between the wire and said ground rod when the wire is inserted into the slot and the cap is forced onto the ground rod.

Various objects and advantages of this invention will become apparent to those skilled in the art from the following detailed description of the preferred embodiment, when read in light of the accompanying drawings.

DETAILED DESCRIPTION OF THE PREFERRED EMBODIMENT

Figure 1:
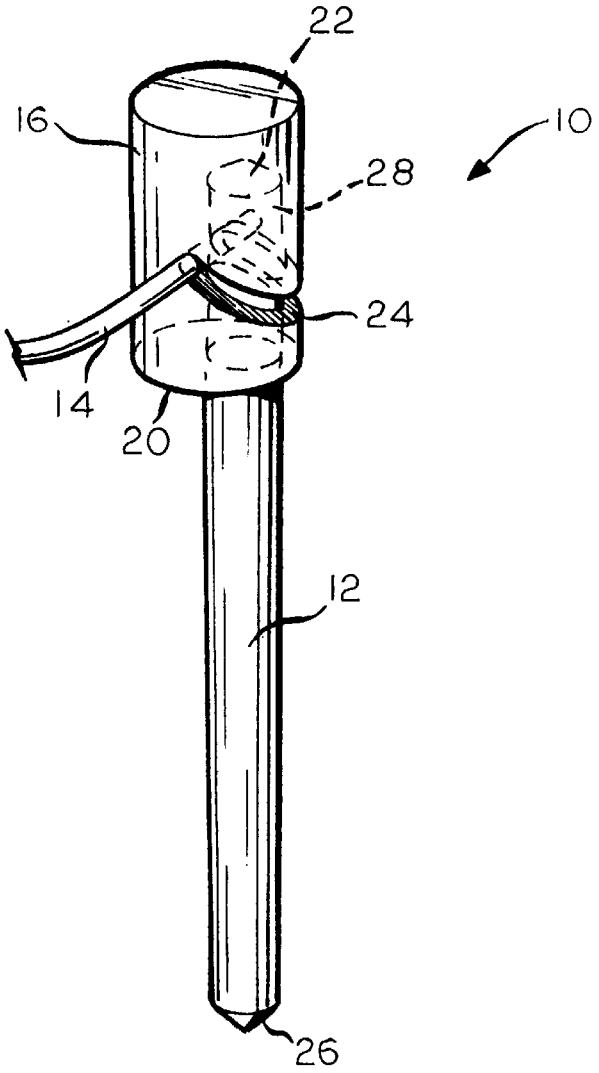
FIG. 1 shows a perspective view of an electrical ground connector assembly according to a first preferred embodiment of the invention.
Figure 2:
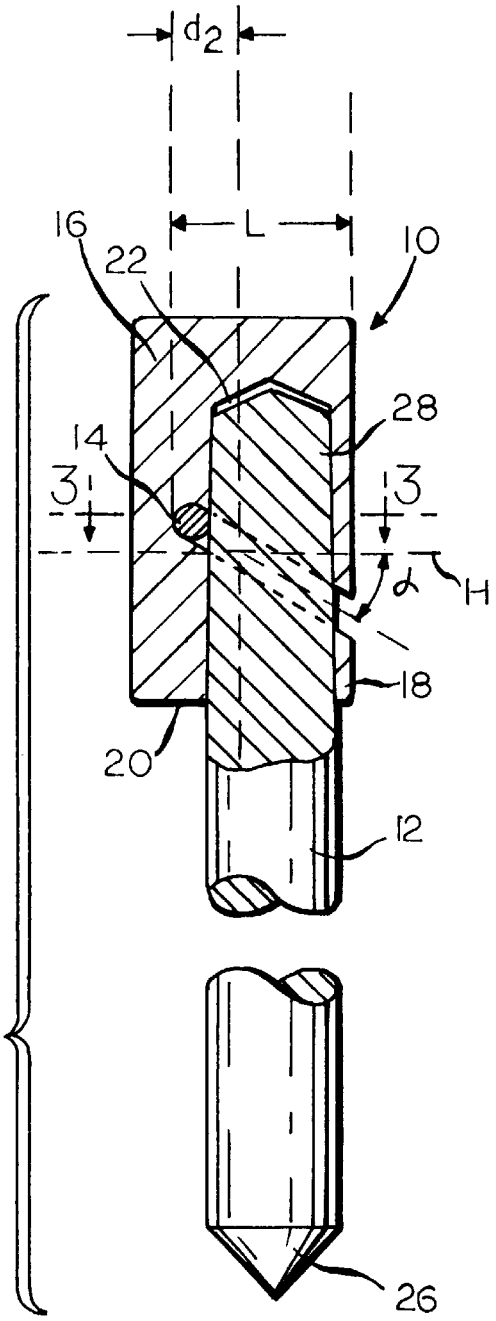
FIG. 2 shows an elevational view of the electrical ground connector assembly of FIG. 1.
Figure 3:
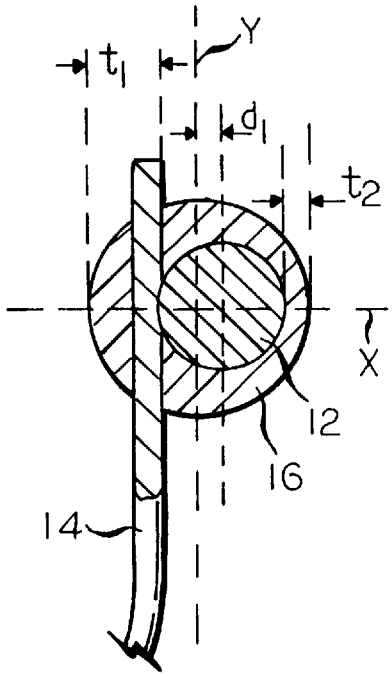
FIG. 3 shows a cross sectional view of the electrical ground connector assembly taken along line 3—3 of FIG. 2.

Referring now to the drawings, there is illustrated in FIGS. 1, 2 and 3 an electrical ground connector assembly, shown generally at 10, according to a first preferred embodiment of the invention. The electrical ground connector assembly 10 includes a ground rod 12, an electrical ground wire or conductor 14 and a cap 16.

The cap 16 can be made of any suitably electrically conductive material, such as copper, brass, galvanized steel, and the like. The cap 16 may be made by casting, machining, forging, cold forming or any other means known by those skilled in the art. The cap 16 is preferably cylindrical in shape with a diameter of approximately 1.000 inches and a height of approximately 1.750 inches. However, it should be appreciated that the cap 16 may be fabricated in any desirable shape.

The cap 16 includes a rod chamber or rod cavity 18 at a first end or bottom 20 terminating at a seat portion at a second end or top 22 within the cap 16. It should be appreciated that the rod chamber 18 may be of any suitable diameter and size to receive and accommodate the ground rod 12 of corresponding diameter and size. The rod chamber 18 is tapered such that the rod chamber 18 has a diameter that is larger than the diameter of the ground rod 12 at the bottom 20 of the cap 16 and a diameter that is smaller than the diameter of the ground rod 12 towards the seat portion 22 of the cap 16. As best seen in FIG. 3, the center of the rod chamber 18 is offset by a distance, $d_1$, of approximately 0.13 inches from the center of the cap 16 such that the rod chamber 18 is non-concentrically positioned along one of the x and y-axis with respect to the cap 16. As a result, the wall thickness, $t_1$, between the rod chamber 18 and the outer surface of the cap 16 is not equal to the wall thickness, $t_2$, between the rod chamber 18 and the outer surface on the opposite side of the cap 16. It should be appreciated that the rod chamber 18 may be positioned such that the rod chamber 18 is non-concentrically positioned along both the x and y-axis with respect to the cap 16.

The cap 16 also includes a slot 24 formed in the side wall of the cap 16. The slot 24 is preferably substantially parallel to or at an angle, $\alpha$, with respect to the horizontal axis, H. In the preferred embodiment, the angle, $\alpha$, is approximately 60 degrees. It should be noted that the angle, $\alpha$, is a function of the diameter of the ground wire 14. For example, a ground wire 14 having a diameter of approximately 0.16 inches, the angle, $\alpha$, is approximately 60 degrees, and for a ground wire 14 having a diameter of approximately 0.32 inches, the angle, $\alpha$, is approximately 30 degrees. Thus, the larger the diameter of the ground wire 14, the smaller the angle, $\alpha$, in order to accommodate the larger diameter ground wire 14. It is envisioned that the angle, $\alpha$, can range from approximately 10 to 75 degrees, depending on the diameter of the ground wire 14.

In the first preferred embodiment, the slot 24 has a sufficient height, h, of approximately 0.1587 inches for accommodating wires of various diameters. The slot 24 also has a length, L, of approximately 0.7 inches, such that the slot 24 passes from one side of the cap 16, traverses the rod chamber 18, and terminates on the other side of the cap 16. Preferably, the slot 24 terminates at a distance, $d_2$, of approximately 0.2 inches from the center of the cap 16. As best seen in FIG. 2, the distance, $d_2$, is sufficient to allow the ground wire 14 to be positioned adjacent the ground rod 12 when the ground rod 12 is inserted into the rod cavity 18. In the preferred embodiment, the slot has a height of approximately 0.16 inches. However, it should be understood that the distance, $d_2$, and the height, h, can be varied so that the cap 16 can accommodate ground wires of various diameters.

The ground rod 12 preferably has a tapered driving point 26 for insertion into the ground by means known to those skilled in the art. The ground rod 12 also includes an upper end 28 with a outer diameter slightly smaller than the inner diameter at the bottom 20 of the rod cavity 18 and slightly larger than the inner diameter at the seat portion 22 of the rod cavity 18. The ground rod 12 can be made of any suitably electrically conductive material, such as copper, brass or galvanized steel. The ground rod 12 may be made by casting, machining, forging, cold forming or any other means known by those skilled in the art. The ground rod 12 is preferably cylindrical in shape with a outer diameter of approximately 0.57 inches, but it should be appreciated that the ground rod 12 may be fabricated in any desirable shape which is complementary in shape to the rod cavity 18.

Figure 4:
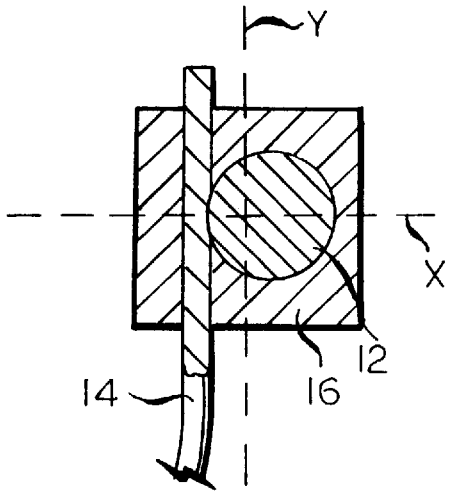
FIG. 4 shows a cross sectional view of the electrical ground connector assembly similar to FIG. 3 according to a second preferred embodiment of the invention.

FIG. 4 shows a cross sectional view of the electrical ground connector assembly 30 according to a second preferred embodiment of the invention. In this preferred embodiment, the electrical ground connector assembly 30 is identical to the electrical ground connector assembly 10 of the first preferred embodiment, except that the cap 32 is rectangular in shape, rather than cylindrical as in the first preferred embodiment of the invention. Preferably, the cap 32 has a length of approximately 1.25 inches along the x-axis, a length of approximately 0.75 inches along the y-axis. It should be noted that the slot angle, $\alpha$, is approximately 30 degrees in the second preferred embodiment of the invention, but may vary between 10 and 75 degrees, in order to accommodate a larger diameter ground wire 14. It should also be noted that the cap 32 may have any dimension along the x- and y-axis in order to accommodate a larger diameter ground wire 14.

In installation, the ground wire 14 is inserted into the slot 24 of the cap 16, 32 until the ground wire 14 passes through the rod cavity 18. The upper end 28 of the ground rod 12 is forced into the rod cavity 18 by any suitable means, such as hammering the cap 16, 32 down over the ground rod 12. When the ground rod 12 contacts the ground wire 14, a secure mechanical and electrical contact by compression between the ground wire 14 and the ground rod 12, as shown in FIGS. 3 and 4. Alternatively, the ground rod 12 can first be driven into the ground, and then the ground wire 14 and cap 16 can be assembled on the ground rod 12 as previously described.

In accordance with the provisions of the patent statutes, the principle and mode of operation of this invention have been explained and illustrated in its preferred embodiment. However, it must be understood that this invention may be practiced otherwise than as specifically explained and illustrated without departing from its spirit or scope.

What is claimed is:

1. An electrical ground connector assembly, comprising:

a ground rod having a lower end and an upper end; and a cap having a first end and a second end, the first end including an opening forming a tapered rod chamber capable of receiving said upper end of said ground rod, said cap including a slot for receiving a wire, the slot having a length, L, traversing from a side wall of said cap through the tapered rod chamber such that a compression contact is made between the wire and said ground rod when the wire is inserted into the slot and said ground rod is forced into the tapered rod chamber of said cap.

2. The electrical ground connector assembly according to claim 1, wherein said cap is cylindrical in shape.

3. The electrical ground connector assembly according to claim 1, wherein said cap is rectangular in shape.

4. The electrical ground connector assembly according to claim 1, wherein said slot is at an angle, $\alpha$, with respect to a horizontal axis of said cap.

5. The electrical ground connector assembly according to claim 4, wherein the angle, $\alpha$, is in a range of approximately 10 to 75 degrees.

6. The electrical ground connector assembly according to claim 4, wherein the angle, $\alpha$, varies as a function of a diameter of the wire.

7. The electrical ground connector assembly according to claim 6, wherein the angle, $\alpha$, becomes smaller as the diameter of the wire becomes larger.

8. The electrical ground connector assembly according to claim 1, wherein the tapered rod chamber has a diameter larger than a diameter of said ground rod at the bottom of said cap and a diameter smaller than the diameter of said ground rod at the top of said cap.

9. The electrical ground connector assembly according to claim 1, wherein the tapered rod chamber is non-concentric with respect to said cap.

10. An electrical ground connector assembly, comprising:

a ground rod; and a cap having a top and a bottom, the bottom including a rod cavity capable of receiving said ground rod, said cap including a slot capable of receiving a wire having a diameter, the slot having an angle, $\alpha$, that varies as a function of the diameter of the wire with respect to a horizontal axis of said cap, wherein a compression contact is formed between the wire and said ground rod when said ground rod is forced into the rod cavity of said cap.

11. The electrical ground connector assembly according to claim 10, wherein said cap is cylindrical in shape.

12. The electrical ground connector assembly according to claim 10, wherein said cap is rectangular in shape.

13. The electrical ground connector assembly according to claim 10, wherein the angle, $\alpha$, becomes smaller as the diameter of the wire becomes larger.

14. The electrical ground connector assembly according to claim 10, wherein the rod chamber is tapered, the rod chamber having a diameter larger than a diameter of said ground rod at the bottom of said cap and a diameter smaller than the diameter of said ground rod at the top of said cap.

15. The electrical ground connector assembly according to claim 10, wherein the tapered rod chamber is non-concentric with respect to said cap.

* * * * *